US012312194B2

(12) United States Patent
Hege et al.

(10) Patent No.: US 12,312,194 B2
(45) Date of Patent: May 27, 2025

(54) DIVERTER CONVEYOR

(71) Applicant: A. G. Stacker Inc., Weyers Cave, VA (US)

(72) Inventors: Dalton Hege, Weyers Cave, VA (US); Eric Stempihar, Rockingham, VA (US); Joseph Wunder, Lexington, VA (US)

(73) Assignee: A. G. Stacker Inc., Weyers Cave, VA (US)

( * ) Notice: Subject to any disclaimer, the term of this patent is extended or adjusted under 35 U.S.C. 154(b) by 402 days.

(21) Appl. No.: 17/878,421

(22) Filed: Aug. 1, 2022

(65) Prior Publication Data

US 2023/0041762 A1 Feb. 9, 2023

Related U.S. Application Data

(60) Provisional application No. 63/228,699, filed on Aug. 3, 2021.

(51) Int. Cl.
*B65H 29/62* (2006.01)

(52) U.S. Cl.
CPC ..... *B65H 29/62* (2013.01); *B65H 2404/262* (2013.01); *B65H 2404/63* (2013.01); *B65H 2404/693* (2013.01); *B65H 2701/1762* (2013.01)

(58) Field of Classification Search
CPC ..... B65H 29/12; B65H 29/62; B65H 29/585; B65H 2404/262; B65H 2404/64; B65H 2404/693
See application file for complete search history.

(56) References Cited

U.S. PATENT DOCUMENTS

| | | | | |
|---|---|---|---|---|
| 3,754,647 | A | 8/1973 | Di et al. | |
| 3,904,019 | A | 9/1975 | Carlen et al. | |
| 4,004,694 | A | 1/1977 | Sjogren | |
| 4,015,840 | A | 4/1977 | Schroder | |
| 4,201,102 | A | 5/1980 | Rudszinat | |
| 4,265,445 | A | 5/1981 | Langner | |
| 4,447,052 | A | 5/1984 | Muller | |
| 4,548,404 | A | 10/1985 | Brandt et al. | |
| 5,211,387 | A | 5/1993 | Lloyd et al. | |
| 5,445,368 | A | 8/1995 | Lester et al. | |
| 6,082,733 | A * | 7/2000 | Borel | B65H 29/58 271/200 |
| 8,069,968 | B2 | 12/2011 | Zimmermann | |
| 8,196,926 | B2 | 6/2012 | Ours et al. | |
| 8,480,550 | B2 * | 7/2013 | Taketsugu | B65H 29/62 53/53 |
| 8,485,520 | B2 | 7/2013 | Nakano | |
| 8,690,153 | B2 | 4/2014 | Ponti | |

(Continued)

*Primary Examiner* — Patrick Cicchino
(74) *Attorney, Agent, or Firm* — J-TEK LAW PLLC; Jeffrey D. Tekanic; Scott T. Wakeman

(57) ABSTRACT

A diverter conveyor includes a main conveyor having an upper deck and a lower deck, the upper deck including a plurality of belts, and the lower deck including a plurality of contact elements such as wheels. A plurality of paddles is mounted downstream of an entrance end of the conveyor and an actuator is configured to shift the plurality of paddles from a first position outside a sheet transport path to a second position extending into the sheet transport path such that the plurality of paddles in the second position diverts sheets from the main transport path into a diverted path and onto a rejection support.

22 Claims, 12 Drawing Sheets

(56) References Cited

U.S. PATENT DOCUMENTS

| | | | | |
|---|---|---|---|---|
| 8,893,959 | B1 * | 11/2014 | Graef | G07D 11/24 235/379 |
| 9,114,432 | B2 | 8/2015 | Mori | |
| 10,071,873 | B2 * | 9/2018 | Allen, Jr. | B65H 29/14 |
| 10,351,380 | B2 * | 7/2019 | Allen, Jr. | B65H 29/18 |
| 2004/0198577 | A1 | 10/2004 | Blumle | |
| 2011/0018192 | A1 | 1/2011 | Moore et al. | |
| 2013/0001042 | A1 * | 1/2013 | Yamamoto | B65H 29/56 198/367.1 |
| 2018/0105383 | A1 * | 4/2018 | Allen, Jr. | B65H 29/50 |

* cited by examiner

DIVERTER CONVEYOR

CROSS-REFERENCE TO RELATED APPLICATIONS

The present application claims the benefit of U.S. provisional patent application No. 63/228,699, filed Aug. 3, 2021, the contents of which are hereby incorporated by reference.

TECHNOLOGICAL FIELD

The present application is directed to a diverter conveyor for conveying a stream of sheets and for selectively diverting one or more sheets from the stream of sheets onto a rejection support. It is also directed to a conveyor system that includes such a diverter conveyor.

BACKGROUND

FIGS. 1-3 illustrate a conventional apparatus for stacking sheets, such as sheets of corrugated paperboard. The stacking system 100 generally comprises a layboy section 102 which receives a stream of sheets, such as those produced by a rotary die cut machine 103 (FIG. 2), and discharges the sheets onto a transfer conveyor 104. The transfer conveyor 104 receives the sheets and transports them to a main conveyor 106. The main conveyor 106 has an intake end 108 and a discharge end 110, and the transfer conveyor has an intake end 112 and a discharge end 114. At the main conveyor intake end 108, the main conveyor 106 is mounted to a base 116 at a pivot point 118 so that the main conveyor 106 may be pivoted to raise its discharge end 110. At the discharge end 110 of main conveyor 106, an accumulator section 120 receives discharged sheets.

In operation, the main conveyor 106 is pivoted about the pivot point 118 to lower the discharge end 110 of the main conveyor 106 to an initial or lowered position, illustrated in FIG. 2. Sheets are fed onto the main conveyor 106 at its intake end 108, transported along the conveyor to its discharge end 110, and discharged from the conveyor toward a backstop 122 in an accumulator section 120. The sheets in the accumulator section 120 settle down, typically onto a discharge conveyor 132, to form a stack of sheets.

It is sometimes desirable to extract or divert sheets from a stream of sheets moving through a stacking system from a rotary die cut machine to a stacker accumulator. This may be done for various reasons, which include, without limitation: 1) diverting the first "n" sheets after a rotary die cut machine starts operating on the basis that the first several sheets output by the rotary die cut machine may not be cut properly and/or may have excessive scrap attached thereto; 2) manually extracting one or more sheets, in response to an operator pushing a button, for example, during normal operation for examination for quality control purposes; 3) automatically periodically extracting one or more sheets, e.g., one sheet after every given number of sheets has passed a point or one sheet at predetermined time intervals, again for quality control purposes; or 4) extracting a sheet in response to a detected condition or defect in a sheet the stream of sheets upstream from the extraction section. For example, a suitable optical scanner could monitor the shape or alignment of passing sheets and trigger the diverter conveyor to extract or divert any sheets that are determined to be defective and/or to have the detected condition.

Such sheet extraction can be performed by the diverter conveyor disclosed in U.S. Pat. No. 10,351,380 which is hereby incorporated by reference. This diverter conveyor can be mounted between two conventional conveyor sections of a sheet stacking system, between a layboy and a transfer conveyor, or between a transfer conveyor and a main conveyor, for example. In the alternative, the diverter conveyor may replace a conventional transfer conveyor.

The diverter conveyor includes a main conveyor path that, during ordinary, non-diverting operation, receives sheets from the output of the layboy and carries those sheets to the input of a stacker. However, when it is desired to extract one or more sheets from the stream of sheets, for the reasons discussed above or other reasons, a set of paddles is actuated to divert the one or more sheets from the stream onto a rejection conveyor. The rejection conveyor may deposit the diverted sheets in a desired location or may deposit the rejected sheets onto a further extraction conveyor to carry the rejected sheets to an operator or to a temporary storage location.

The diverter conveyor of the '380 patent functions adequately to perform the above functions. However, it would be desirable to further improve the performance of diverter conveyors.

SUMMARY

Improvements to diverter conveyors are provided by embodiments of the present invention, a first aspect of which comprises a diverter conveyor configured to transport sheets along a main transport path in a downstream direction from an input end to a discharge end. The diverter conveyor includes a main conveyor having an upper deck and a lower deck. The upper deck includes at least one first belt support at the input end and at least one second belt support downstream from the first belt support and a plurality of belts each extending from the first belt support to the second belt support, lower runs of the plurality of belts lying in a first plane or being bounded by the first plane. The lower deck includes a plurality of first lower shafts, and an upstream-most one of the first lower shafts is located downstream from the first upper belt support. Each of the first lower shafts supports a plurality of contact elements, and each of the contact elements has a contact surface movable around a closed path from a contact region to a non-contact region, the contact regions lying in a second plane or being bounded by the second plane. The conveyor also includes a nip support at the input end that forms an entrance nip with the plurality of belts and a rejection support located beneath the main conveyor. A plurality of paddles is mounted at a first gap between the nip support and the upstream-most one of the plurality of first shafts, and an actuator is operably connected to the plurality of paddles and configured to shift the plurality of paddles from a first position outside the sheet transport path to a second position extending into the sheet transport path. The main transport path of the diverter conveyor is defined by the lower runs of the belts and by the nip support and by the contact surfaces of the plurality of contact elements in the contact region. The diverter conveyor is configured such that the sheets make direct contact with the lower runs of the belts and make direct contact with the contact surfaces of the plurality of contact elements in the contact region when the sheets move along the main transport path. Also, the plurality of paddles in the second position is configured to divert the sheets from the main transport path into a diverted path and onto the rejection support.

BRIEF DESCRIPTION OF THE DRAWINGS

These and other aspects of the disclosure will be better understood after a reading of the following detailed description in connection with the attached drawings in which.

DETAILED DESCRIPTION

Figure 4:
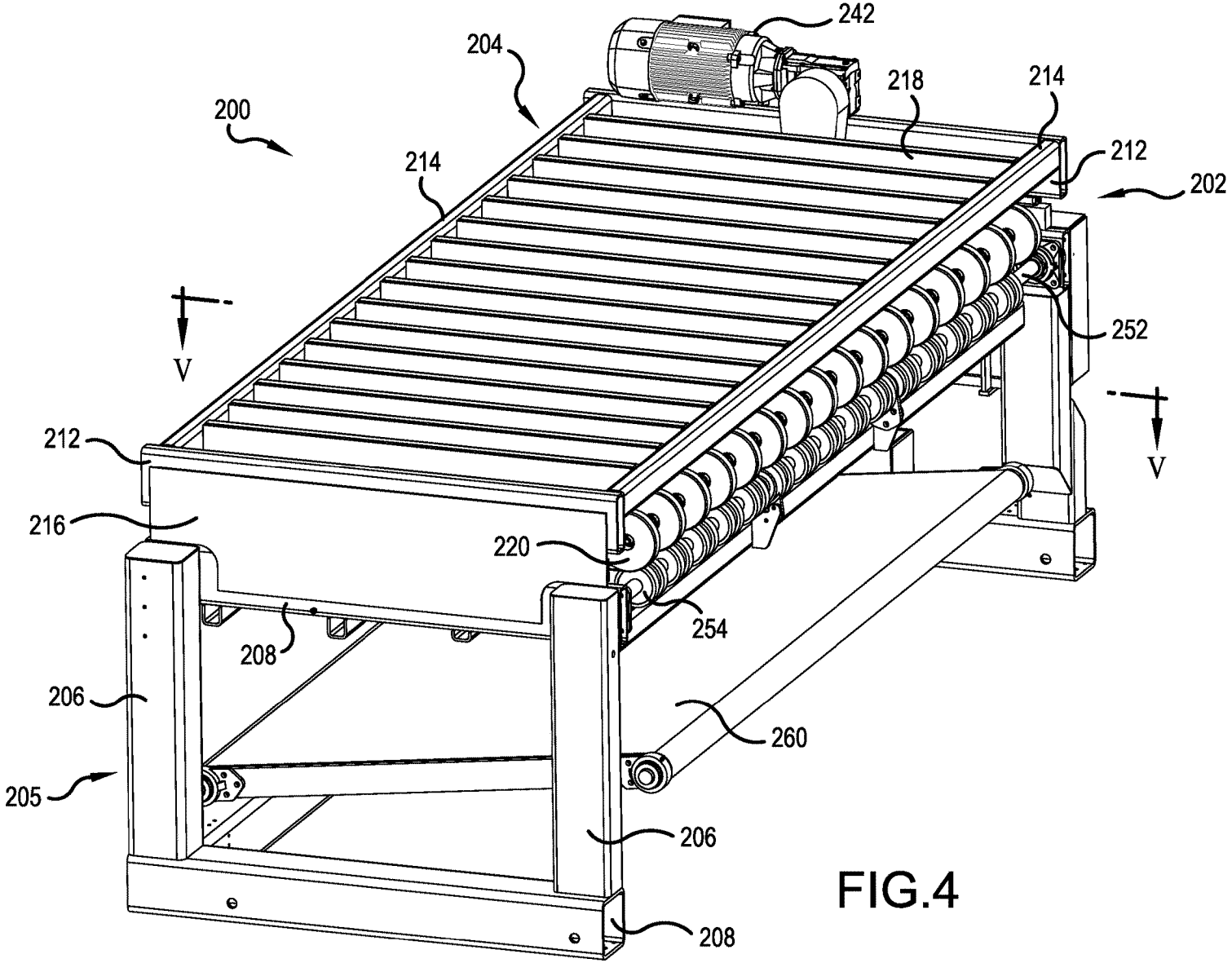
FIG. 4 is a side perspective view of a diverter conveyor according to an embodiment of the present disclosure.

Referring now to the drawings, wherein the showings are intended to illustrate a presently preferred embodiment of the invention only and not to limit same, FIG. 4 shows a diverter conveyor 200 according to the present disclosure. The diverter conveyor has an upstream or input end 202 at which sheets of material (not illustrated) are received at the diverter conveyor 200 and a downstream or discharge end 204 from which the sheets of material exit the diverter conveyor 200. The diverter conveyor 200 includes a lower frame 205 having four vertical support legs 206 connected by upper and lower longitudinal supports 208 and an upper frame 210 that includes two longitudinal supports 212 running from the input end 202 to the discharge end 204 and two transverse supports 214 that extend perpendicularly to the longitudinal supports 212. The upper frame 210 is connected to the lower frame 205 by two side plates 216 connected between the upper longitudinal supports 208 of the lower and the longitudinal supports 212 of the upper frame 210.

As used herein, the direction from the input end to the discharge end may be referred to as the "downstream direction" or the "longitudinal direction," or the "first direction," the direction perpendicular to the longitudinal direction in a generally horizontal plane may be referred to as the "transverse direction" or the "second direction," and the direction perpendicular to both the longitudinal direction and the transverse direction may be referred to as the "vertical direction" or the "third direction."

Figure 5:
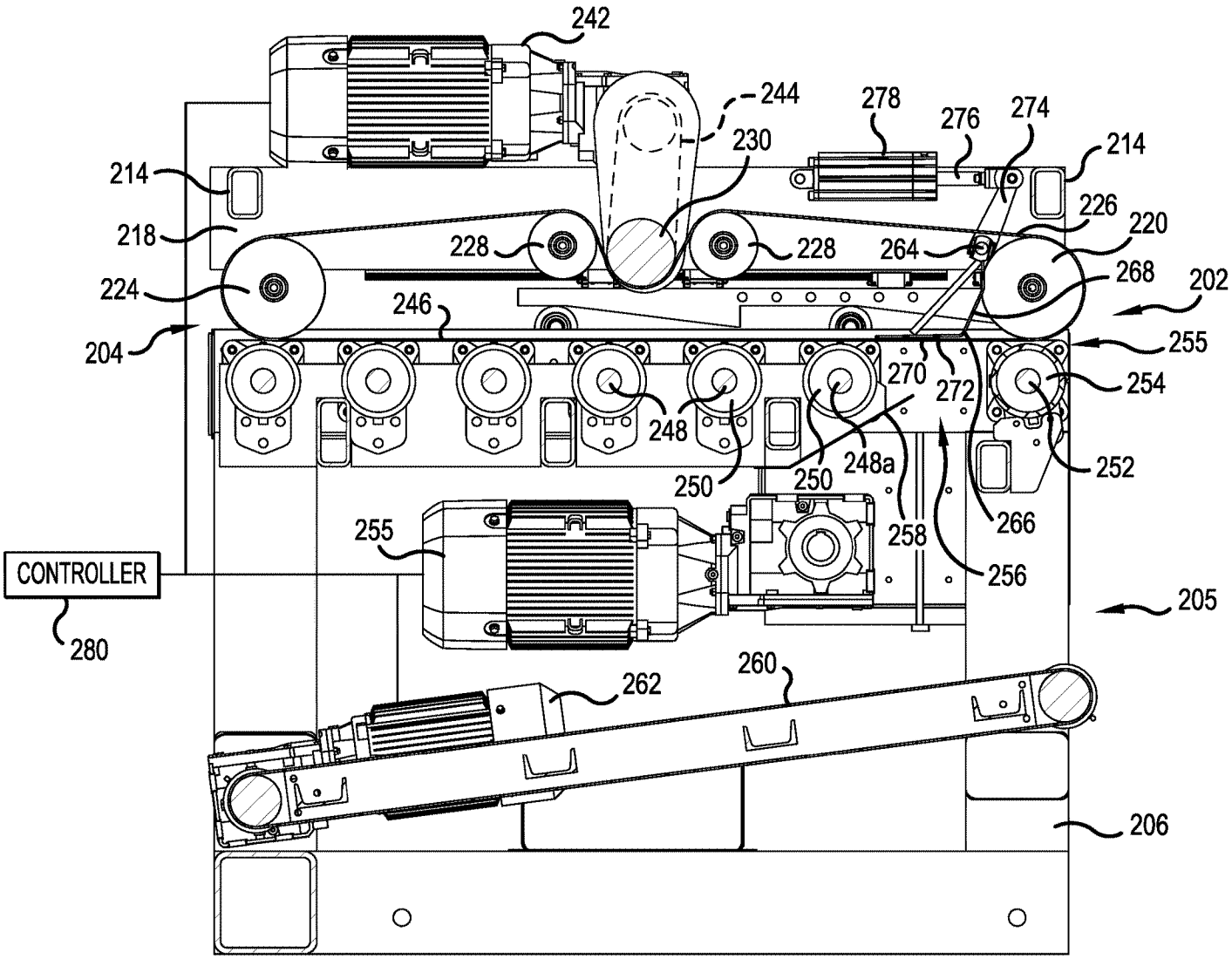
FIG. 5 is sectional side elevational view taken in the direction of line V-V in FIG. 4 with the paddles of the diverter conveyor in a raised position.
Figure 6:
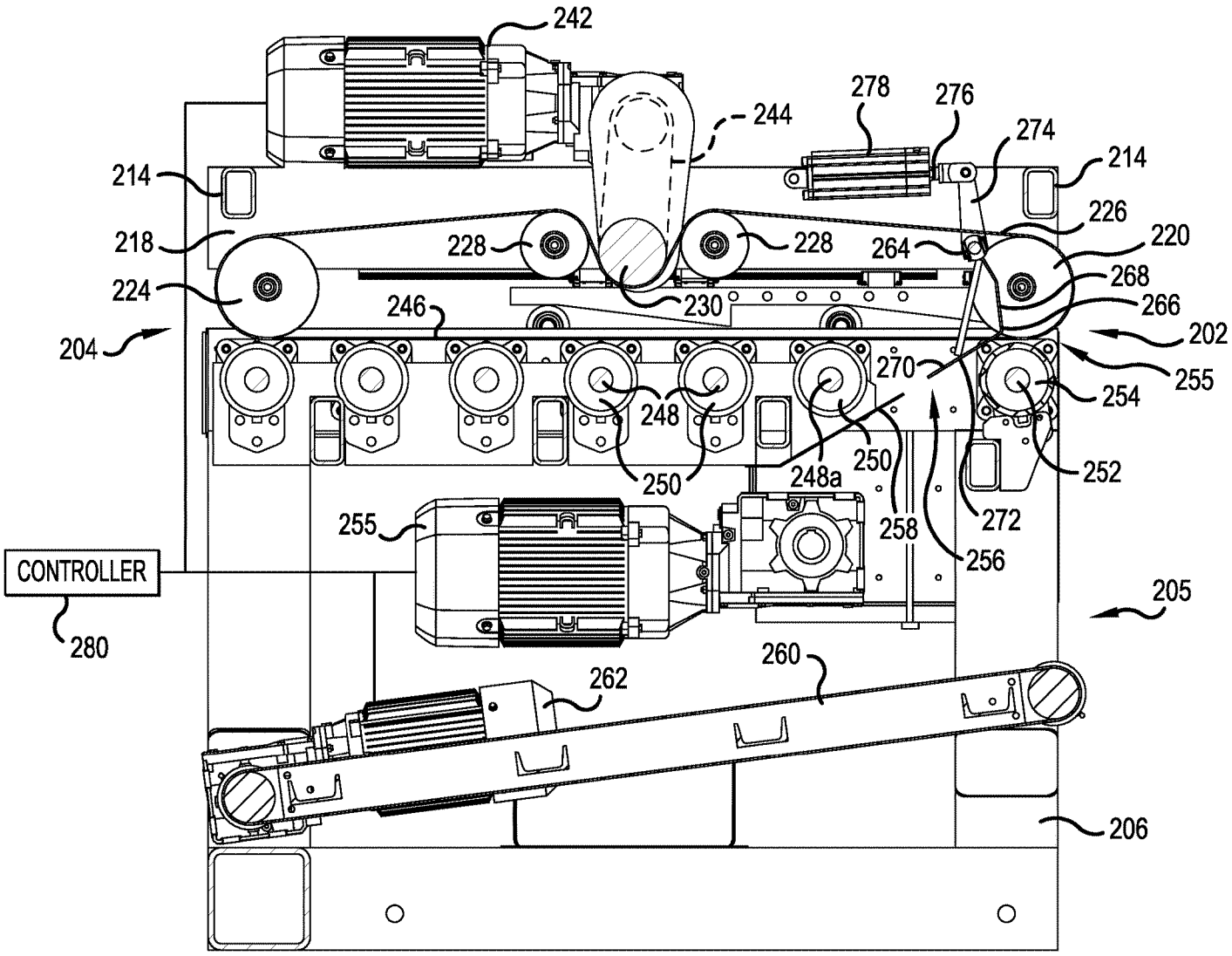
FIG. 6 is a sectional side elevational view taken in the direction of line V-V in FIG. 4 with the paddles of the diverter conveyor in a lowered position.
Figure 8:
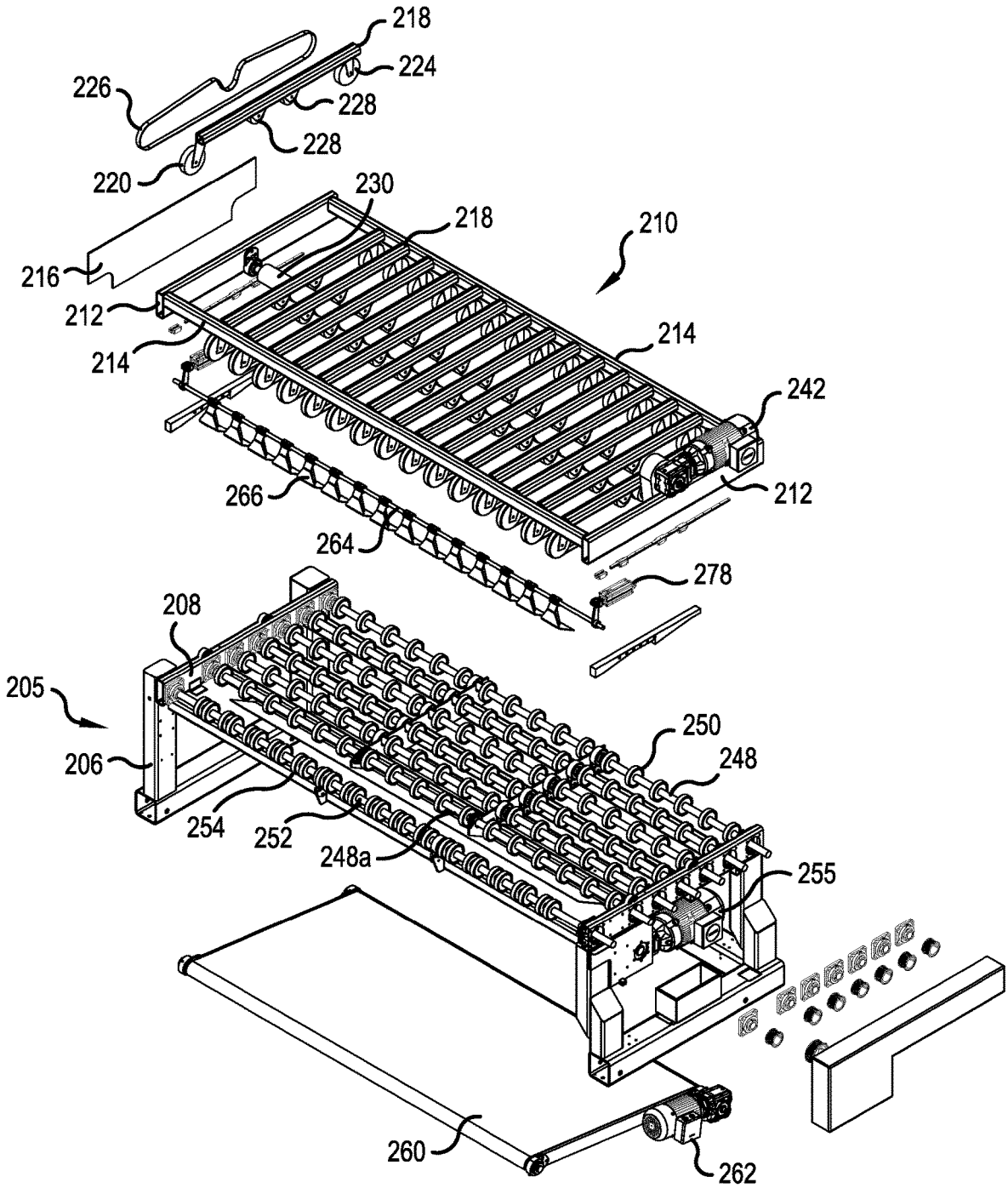
FIG. 8 is an exploded perspective view of the diverter conveyor of FIG. 4.

Referring now to FIGS. 5, 6 and 8, a plurality of pulley supports 218 extend between the upstream and downstream transverse supports 214. A plurality of first pulleys 220 are rotatably supported at the upstream ends of the pulley supports 218, and a plurality of second pulleys 224 are rotatably supported at the downstream ends of the pulley supports 218. A belt 226 extends between each longitudinally aligned pair of the first pulleys 220 and the second pulleys 224 and forms a closed loop with the first pulleys 220 and the second pulleys 224 inside the closed loop.

Two idler pulleys 228 are located between each first pulley 220 and second pulley 224 inside the closed loop, and a drive roller 230 presses downwardly on a portion of the belt 226 between the idler pulleys 228 from outside the closed loop. The drive roller 230 is operatively connected to a first drive 242 by a drive belt 244 so that operating the first drive 242 causes the drive roller 230 to rotate and move each of the belts 226 around a path. The pulley supports 218, the first and second pulleys 220, 224 and the belts 226 may be referred to as the "upper deck" of the conveyor.

The lower runs 246 of the belts 226 lie substantially in a first plane, which first plane is usually parallel to the surface on which the diverter conveyor 200 is supported. The first plane defines an upper boundary of a main sheet transport path through the diverter conveyor 200.

A plurality of first lower shafts 248 extend between the longitudinal supports 208 of the lower frame 205 and each supports a plurality of first wheels 250. The upstream-most one of the first lower shafts 248, which is designated first lower shaft 248*a*, is located downstream of the first upper shaft 218. The first wheels 250 are contact elements that are make direct contact with sheets of material moving along the main transport path. Each of the first wheels 250 has an outer or contact surface that is movable around a closed path from a contact region at the top of the first wheel 250 where direct contact with a sheet of material will occur, and a non-contact region. The contact regions or tops of the first wheels 250 lie in a second plane or are bounded by the second plane that is parallel to the first plane and defines a lower boundary of the main sheet transport path through the diverter conveyor 200. The first lower shafts 248 form a lower deck of the diverter conveyor 200.

A single second lower shaft 252 extends between the longitudinal supports 208 of the lower frame 205 and supports a plurality of second wheels 254. A second drive 255 is operably connected to the ends of the first lower shafts 248 and the end of the second lower shaft 252 by a belt (not illustrated) to rotate the first lower shafts 248 and the second lower shaft 252 to carry sheets of material along the lower deck of the conveyor 200.

Figure 7:
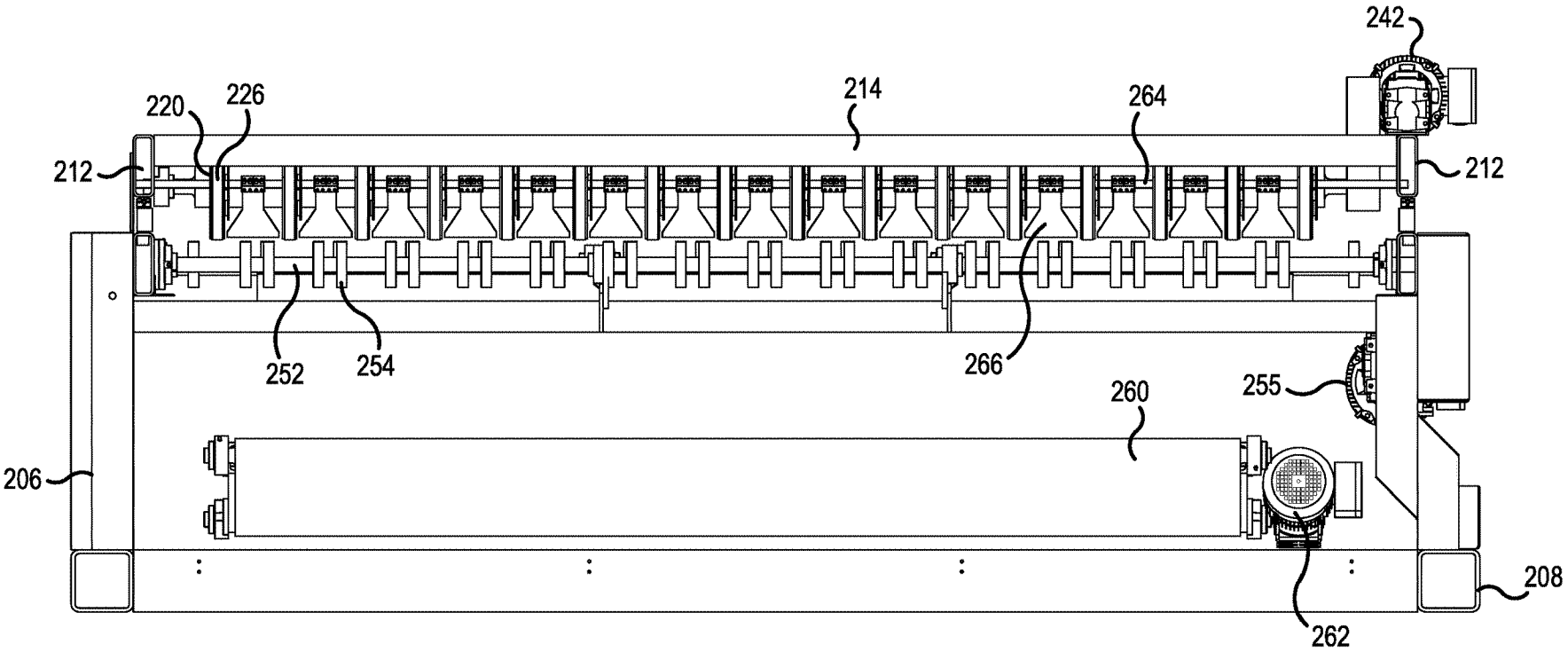
FIG. 7 is a front elevational view of the diverter conveyor of FIG. 4.

The second wheels 254 and the belts 226 form an entrance nip 255 at the input end 202 of the diverter conveyor 200. As shown in FIG. 7, the second wheels 254 may be offset from the belts 226 in the transverse direction. Whether the belts 226 and second wheels 254 are transversely aligned or offset, the location where an incoming sheet of material is first engaged by both the second wheels 254 and the belts 226 is referred to as the "entrance nip." The second lower shaft 252 and the second wheels 254 constitute a nip support that cooperates with the belts 226 to form the entrance nip 255. In the alternative, a short belt section (not illustrated) or a low friction plate could function as the nip support.

A gap 256 is located between the second lower shaft 252 and the upstream-most first lower shaft 248*a* which gap 256 is larger than the gaps that separate the first lower shafts 248 from each other. A diverter plate 258 connected to the lower frame 205 extends into the gap 256 from below at an angle. A diverter conveyor 260 is located beneath the diverter plate 258 and extends at a downward angle from the input end 202 to the discharge end 204 of the diverter conveyor 200. A third drive 262 drives the diverter conveyor 260.

A paddle shaft 264 extends between and is supported by the longitudinal supports 212, and a plurality of paddles 266 are connected to the paddle shaft 264 for rotation therewith. The paddles 266 each include a first portion 268 that extends from the paddle shaft 264 and a second portion 270 that extends from the first portion 268 at an angle and that has a flat bottom surface 272. An arm 274 has a first end fixedly connected to the paddle shaft 264 and extends upward from the paddle shaft 264 to a second end. The second end of the arm 274 is connected to a movable rod 276 of a fourth drive 278 which, in the present embodiment, is a linear actuator but could alternately be a hydraulic or pneumatic cylinder.

When the movable rod 276 is in the extended position illustrated in FIG. 5, the paddles 266 are in a raised position in which the second portions 270 of the paddles 266 are located above and parallel to the main sheet transport path at a position out of the main sheet transport path and above the first plane. When the movable rod 276 is retracted as illustrated in FIG. 6, the paddles 266 are in a lowered position in which the second portions 270 of the paddles 266 extend into the main sheet transport path. As best seen in FIG. 7, the first portions 268 and the second portions 270 of the paddles 266 have a width in the transverse direction that is less than a transverse spacing between adjacent pairs of the belts 226 and can thus pass between the belts 226 when shifting from the raised position of FIG. 5 to the lowered position of FIG. 6.

Figure 1:
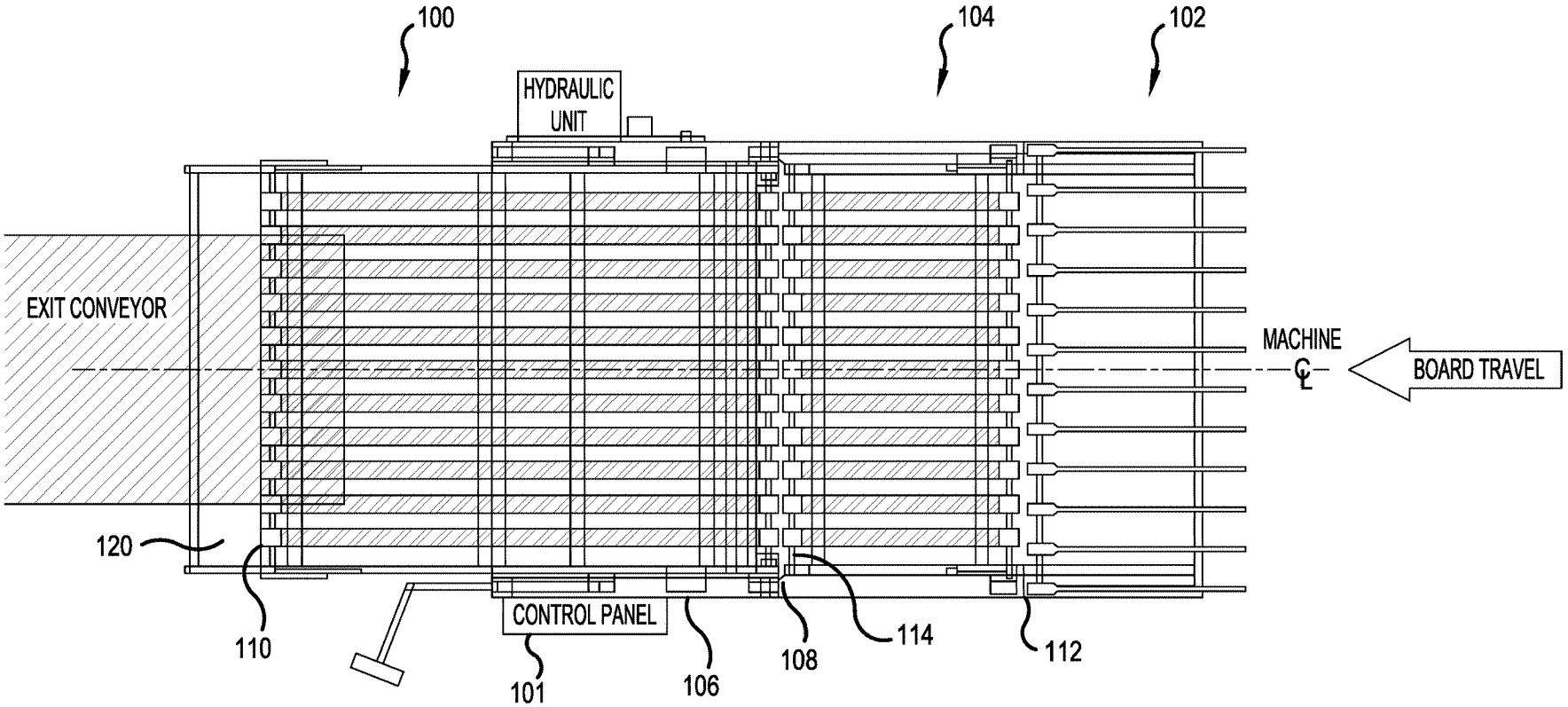
FIG.1 CONVENTIONAL ART
FIG. 1 is top plan view of a conventional stacking system.
Figure 2:
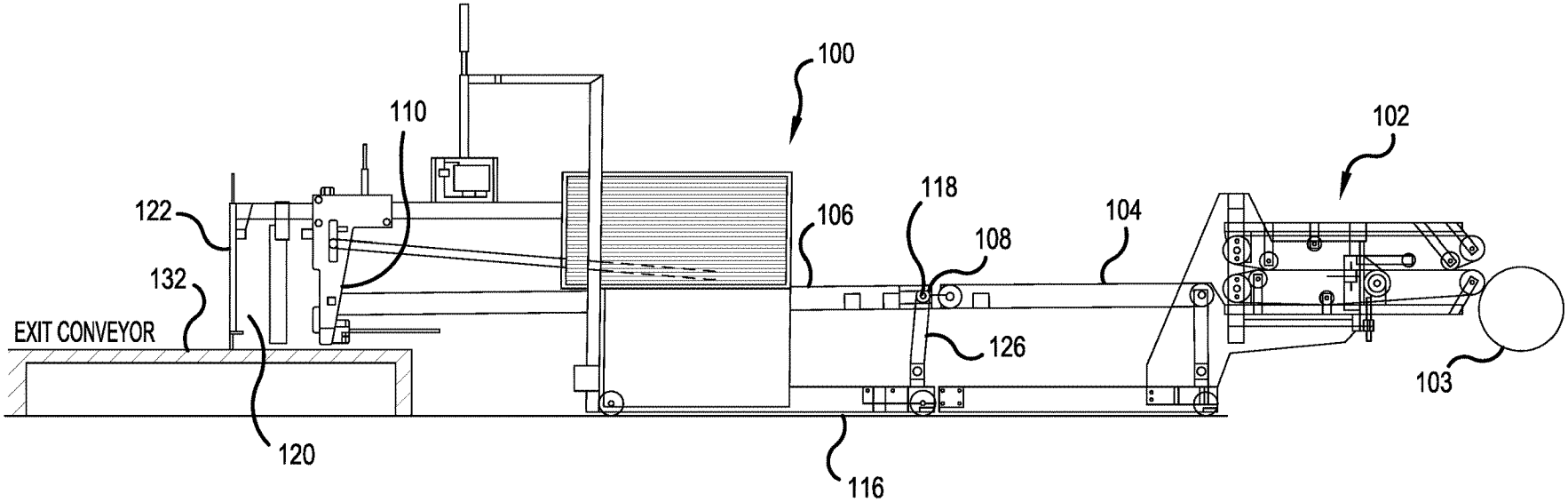
FIG.2 CONVENTIONAL ART
FIG. 2 is a side elevational view of the stacking system of FIG. 1 with the end of the stacker main conveyor in a lowered position.
Figure 3:
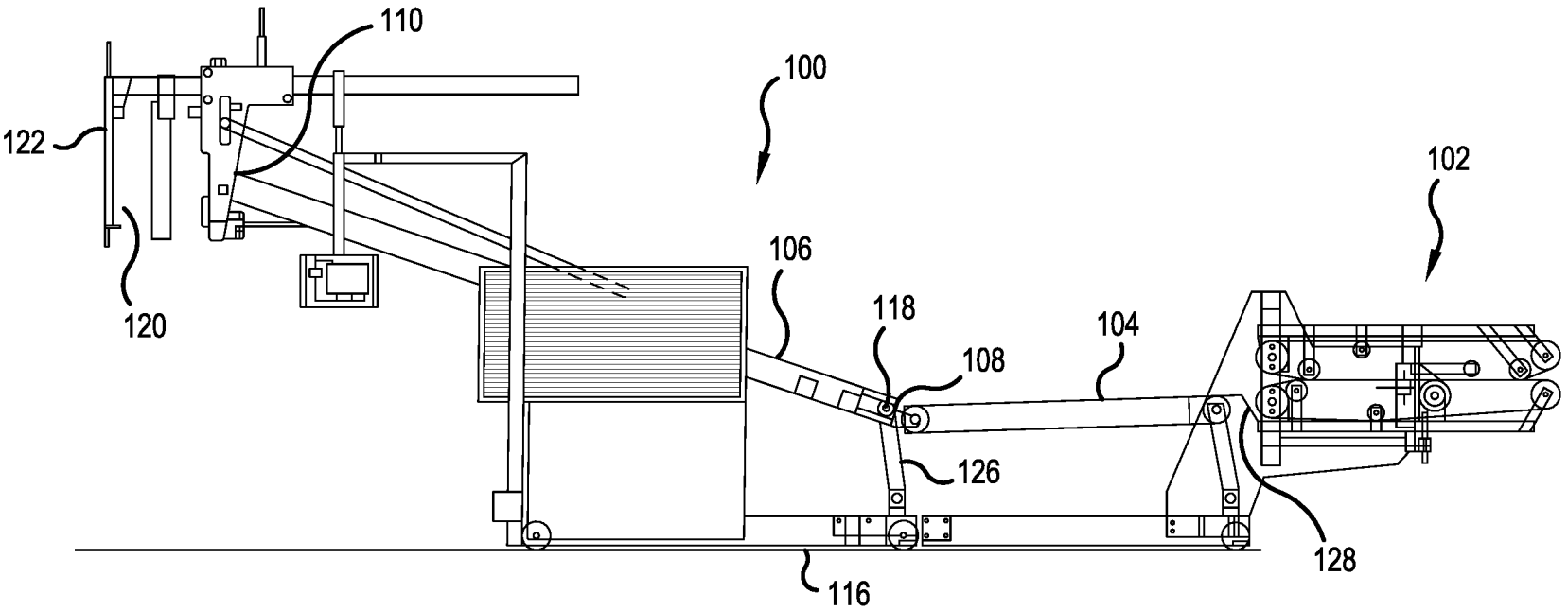
FIG.3 CONVENTIONAL ART
FIG. 3 is a side elevational view of the stacking system of FIG. 2 with the end of the stacker main conveyor in a raised position.

The first drive 242, the second drive 255, the third drive 262 and the fourth drive 278 are connected to a controller 280 that is schematically illustrated in FIGS. 5 and 6 but which is preferably located in a control panel 101 as shown in FIG. 1 which controls the overall conveyor system. The controller controls the first drive 242 and the second drive 255 to move the belts 226 and the first wheels 250 at a substantially same rate to move sheets of material through the diverter conveyor 200.

The main sheet transport path of the diverter conveyor 200 extends from the entrance nip 255 at the input end 202 of the diverter conveyor above the gap 256 and between the lower runs 246 of the belts 226 and the contact surfaces of the first wheels 250 to the discharge end 204 of the diverter conveyor. Sheets of material moving through the diverter conveyor 200 follow the main transport path when the paddles 266 are located in the raised position. The diverter conveyor 200 also includes a diverted transport path, and the sheets follow the diverted transport path when the paddles 266 are in the lowered position. The diverted transport path begins at the entrance nip 255 and is defined in part by the flat bottom surfaces 272 of the paddles 266 and by the diverter plate 258 and by the upper surface of the diverter conveyor 260.

Figure 9:
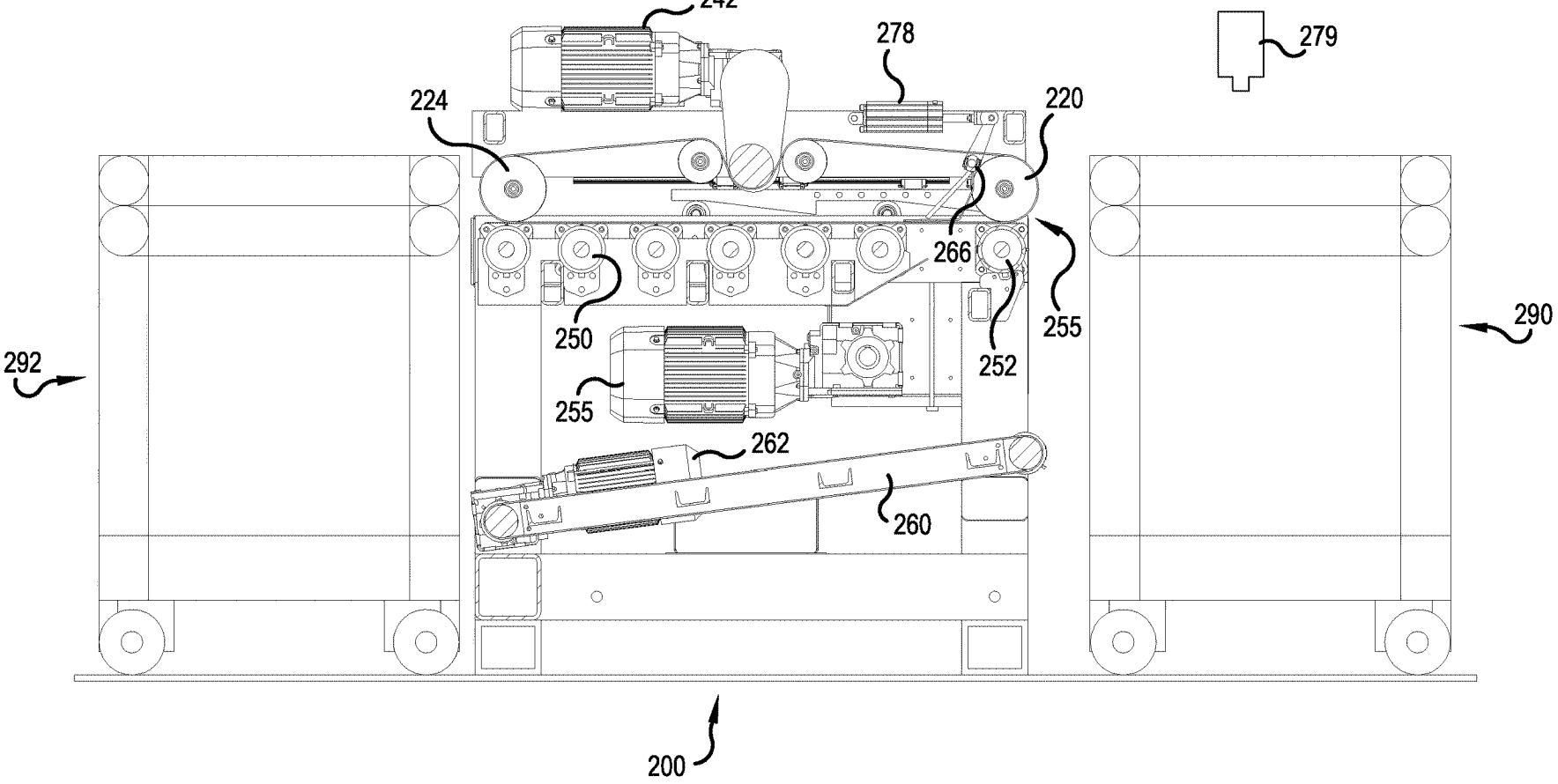
FIG. 9 is a side elevational view, partly in section, of the diverter conveyor of FIG. 4 mounted between an input conveyor and an output conveyor.

In operation, sheets of material (not illustrated) arrive at the entrance nip 255 from a feeding conveyor 290 (FIG. 9) or a rotary die cut machine (not illustrated) and are drawn into the main transport path by the counter rotating belts 226 and the second wheels 254. When the paddles 266 are in the raised position, the sheets pass over the gap 256 to the first wheels 250 on the upstream-most first shaft 248*a*, over the first wheels 250 on the remaining first shafts 250 and out the discharge end 204 of the diverter conveyor 200 to a receiving conveyor 292.

When it is desired to remove one or more sheets from the main transport path for inspection, either in response to a signal from an operator or a signal generated by a detector 279 (FIG. 9) that has detected a condition requiring a sheet to be ejected, the controller 280 causes the fourth drive 272 to retract the movable rod 276 to pull the second end of the arm 274 toward the fourth drive 272 which pivots the paddle shaft 264 and the paddles 266 connected thereto down into the gap 256 immediately downstream from the entrance nip 255. The leading edge of the next sheet passing through the entrance nip 255 will impact against the bottom surfaces 272 of the paddles 266 and move under the diverter plate 258 and, when the trailing edge of the sheet exits the entrance nip 255, the diverted sheet will fall onto the diverter conveyor 260. The diverter conveyor 260 can then be driven by the controller 280 operating the third drive 262 to move the diverted sheet out of the diverter conveyor 200.

Figure 10:
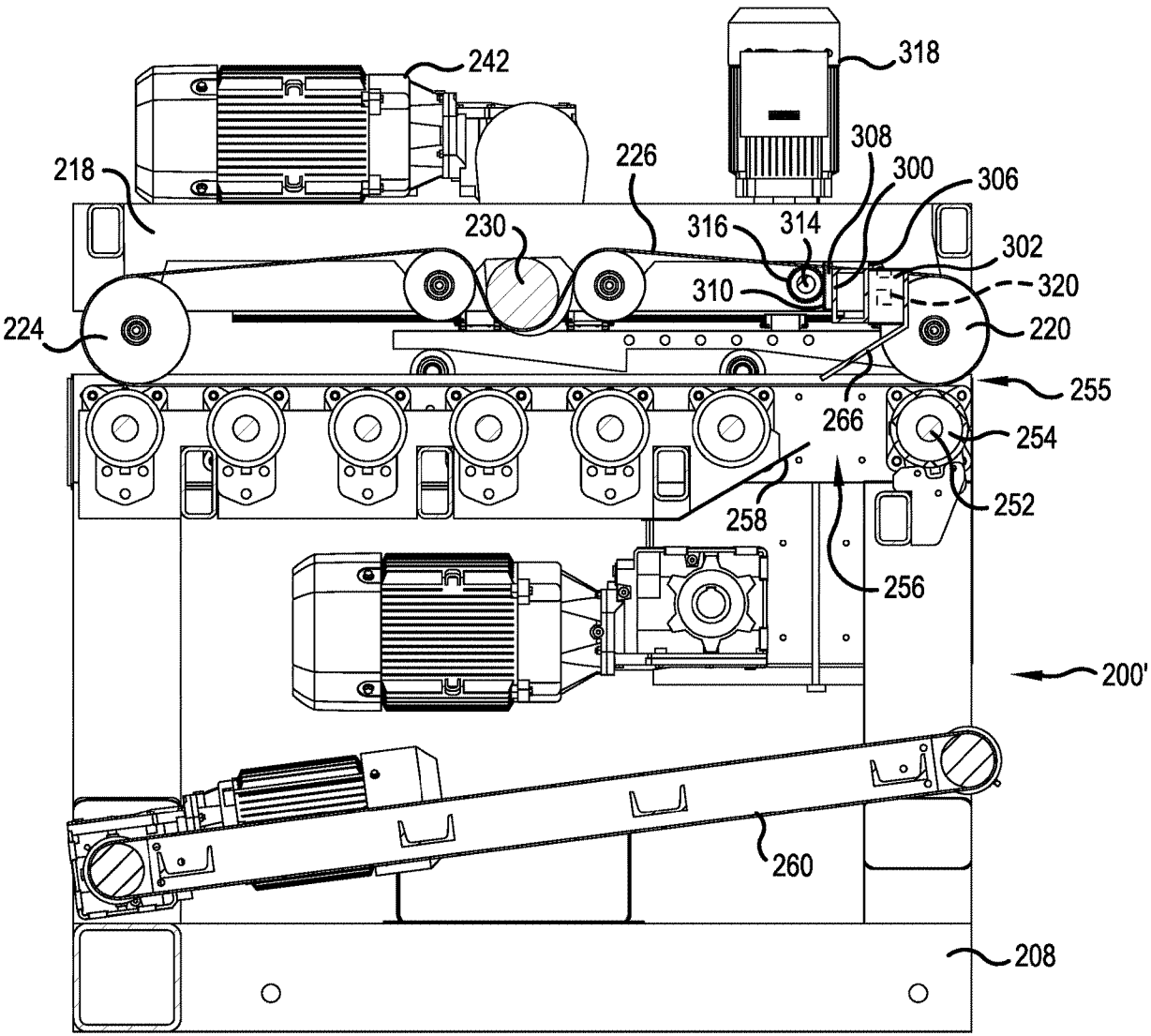
FIG. 10 is a sectional side elevational view similar to that of FIG. 5 but showing a second embodiment of a diverter conveyor having an alternate mechanism for raising and lowering the paddles.
Figure 11:
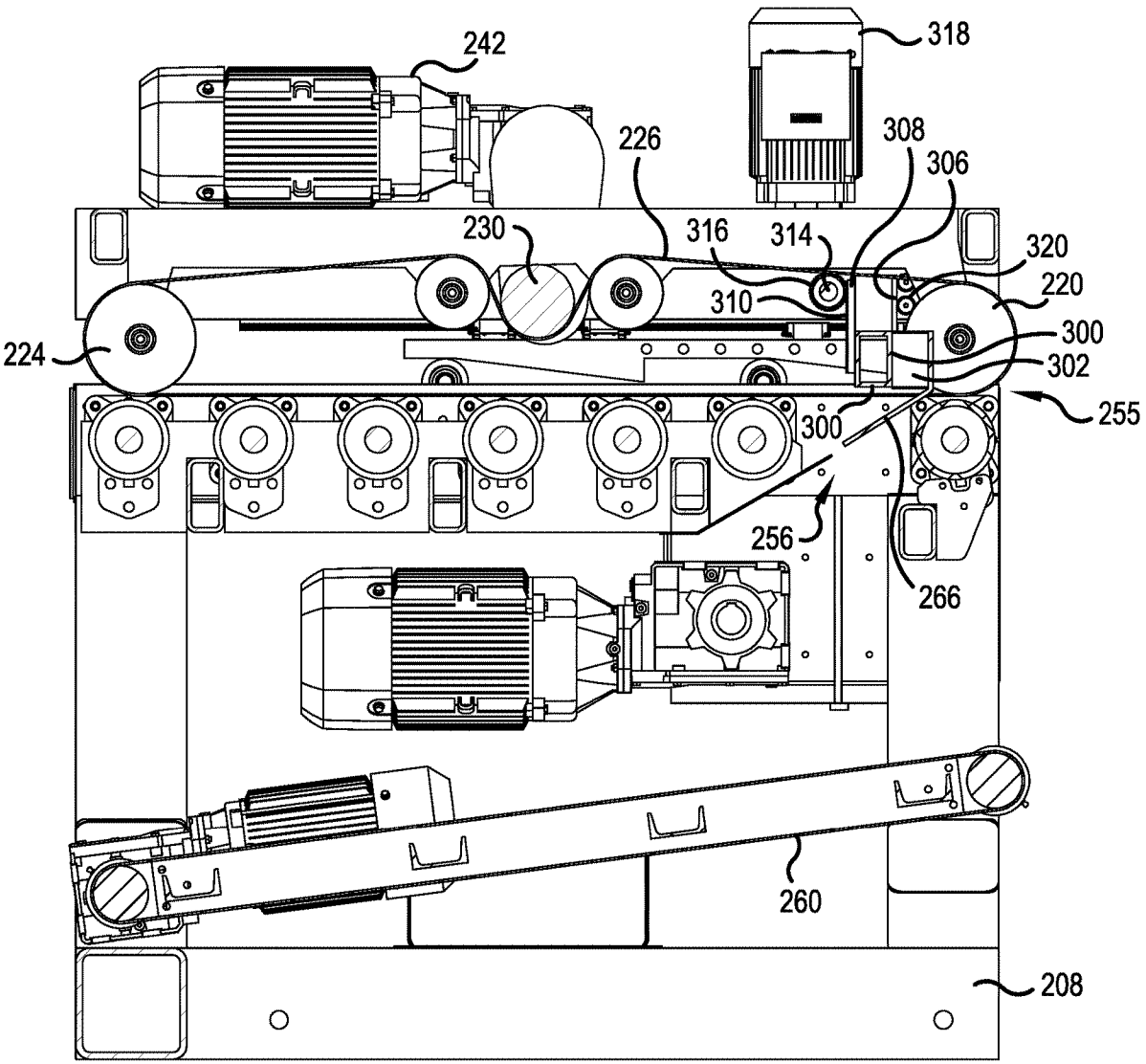
FIG. 11 is a sectional side elevational view similar to that of FIG. 6 but showing the alternate mechanism for raising and lowering the paddles.
Figure 12:
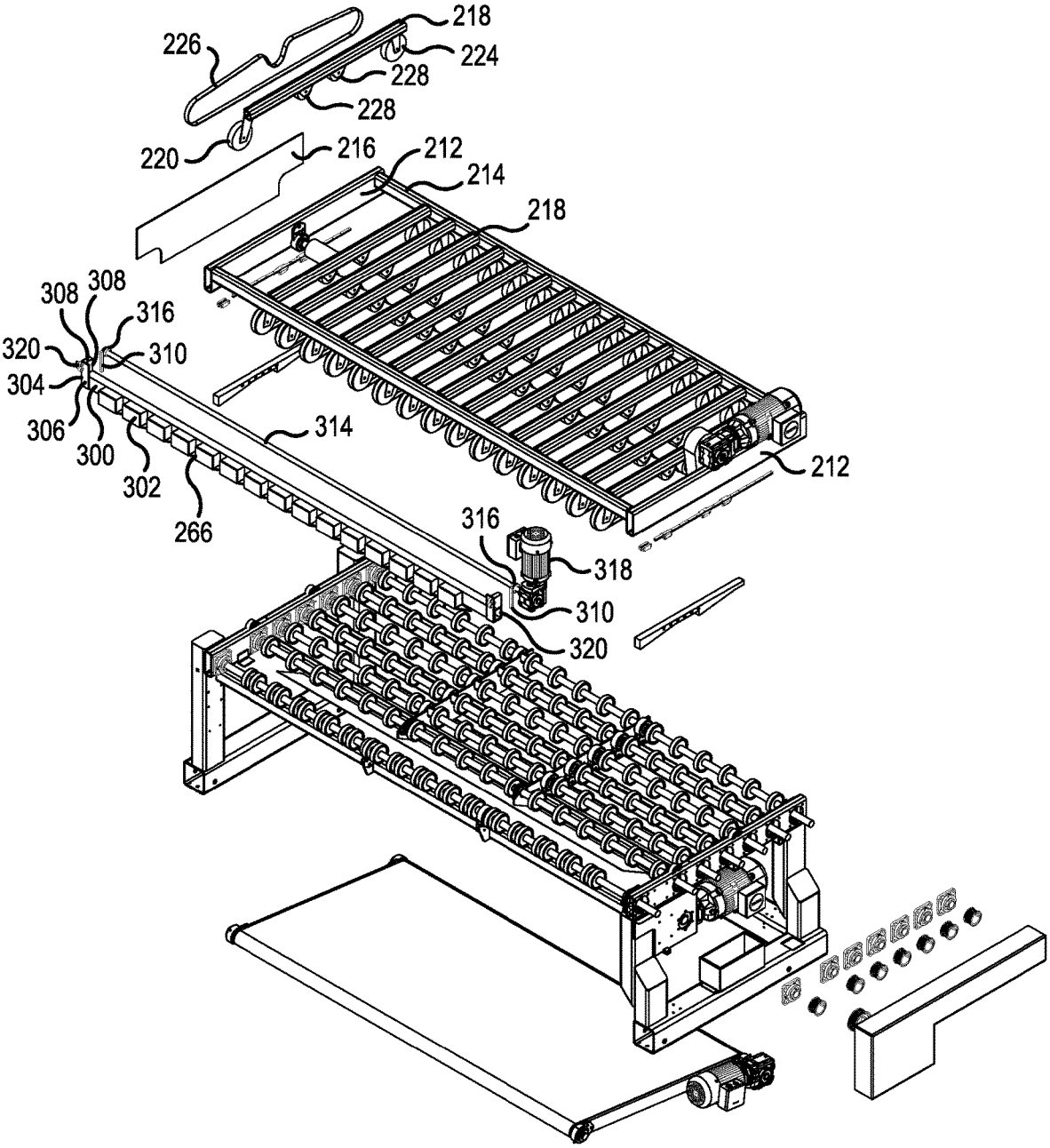
FIG. 12 is an exploded view of the diverter conveyor of FIGS. 9 and 10.

FIGS. 10-12 show a second embodiment of a diverter conveyor 200' which differs from the first embodiment of the diverter conveyor 200 only in the configuration of the support and the actuators for the paddles. Elements of the second embodiment of the diverter conveyor 200' common to first embodiment of the diverter conveyor are identified by the same reference numerals.

Referring now to FIG. 12, the paddles 266 are connected to a transverse beam 300 by mounting blocks 302. An L-shaped bracket 304 is mounted at each end of the transverse beam 300, and each L-shaped bracket 304 includes a guide wall 306 that faces in the upstream direction and a support wall 308 that faces in the transverse direction and supports a vertically extending gear rack 310 on its downstream end. A drive shaft 314 extends between the longitudinal supports 212 and is rotationally supported by the longitudinal supports 212. A drive gear 316 is mounted at each end of the drive shaft 314 near the longitudinal supports 212, and a fourth drive 318 mounted to one of the longitudinal supports 212 is operatively connected to the drive shaft 314 to rotate the drive shaft 314 and the drive gears 316. A pair of guide rollers 320 arranged one above the other extends from the facing inner sides of the longitudinal supports 212.

Referring now to FIGS. 10 and 11, the transverse beam 300 is mounted with the guide walls 306 of the L-shaped brackets 304 against the guide rollers 320 and with each of the drive gears 316 in engagement with one of the gear racks 310. With the drive shaft 314 rotatably fixed by the fourth drive 318, the drive gears 316 and the guide rollers 320 fix the location of the transverse beam 300 and thus the paddles 266 vertically and in the longitudinal direction.

The paddles are shiftable from a raised position illustrated in FIG. 10 to a lowered position illustrated in FIG. 11 by operating the fourth drive 318 (under the control of the controller 280) to rotate the drive shaft. Because the drive gears 316 are in engagement with the gear racks 310, the rotation of the drive gears 316 moves the gear racks 310 and thus the transverse beam upward and downward relative to the longitudinal supports 212.

The operation of this embodiment of the diverter conveyor 200' is identical to the operation of the first embodiment of the diverter conveyor 200 except that the paddles 266 are raised and lowered in a linear manner by the drive gears 316 and gear racks 310 rather than by the pivoting motion discussed above in connection with the first embodiment.

As a further embodiment, not illustrated, linear actuators could be used in place of the fourth drive 318 to raise and lower the transverse beam 300. In that case, the drive shaft 314 and drive gears 316 would help to guide the movement of the transverse beam and keep it level but would no longer play a roll in moving the transverse beam 300.

The present invention has been described above in connection with presently preferred embodiments. Modifications and additions to these embodiments will become apparent after a review of the present application, and it is intended that all such modifications and additions form a part of the present invention to the extent they fall within the scope of the several claims appended hereto.

What is claimed is:

1. A diverter conveyor configured to transport sheets along a main transport path in a downstream direction from an input end to a discharge end, the diverter conveyor comprising:

a main conveyor including an upper deck and a lower deck, the upper deck including at least one first belt support at the input end and at least one second belt support downstream from the first belt support and a plurality of belts each extending from the first belt support to the second belt support, lower runs of the plurality of belts lying in a first plane or being bounded by the first plane, and the lower deck including a plurality of first lower shafts, an upstream-most one of the first lower shafts being located downstream from the first belt support, each of the first lower shafts supporting a plurality of contact elements, each of the contact elements having a contact surface movable around a closed path from a contact region to a non-contact region, the contact regions lying in a second plane or being bounded by the second plane;

a nip support at the input end forming an entrance nip with the plurality of belts;

a rejection support located beneath the main conveyor;

a plurality of paddles mounted at a first gap between the nip support and the upstream-most one of the plurality of first shafts; and an actuator operably connected to the plurality of paddles and configured to shift the plurality of paddles from a first position outside the sheet transport path to a second position extending into the sheet transport path, wherein the main transport path of the diverter conveyor is defined by the lower runs of the belts and by the nip support and by the contact surfaces of the plurality of contact elements, wherein the diverter conveyor is configured such that the sheets make direct contact with the lower runs of the belts and make direct contact with the contact surfaces of the plurality of contact elements when the sheets move along the main transport path, and wherein the plurality of paddles in the second position is configured to divert the sheets from the main transport path into a diverted path and onto the rejection support.

2. The diverter conveyor according to claim 1, wherein the contact elements of the plurality of contact elements are first wheels.

3. The diverter conveyor according to claim 2 wherein the rejection support is a rejection conveyor.

4. The diverter conveyor according to claim 3, wherein the nip support comprises a second lower shaft supporting a plurality of second wheels.

5. The diverter conveyor according to claim 4, including a frame, wherein the main conveyor, the plurality of paddles and the actuator are supported by the frame.

6. The diverter conveyor according to claim 1, wherein:

the at least one first belt support comprises a plurality of first pulleys, the at least one second belt support comprises a plurality of second pulleys, and each of the plurality of belts extends from one of the first pulleys to one of the second pulleys.

7. A diverter conveyor configured to transport sheets along a main transport path in a downstream direction from an input end to a discharge end, the diverter conveyor comprising:

a main conveyor including an upper deck and a lower deck, the upper deck including at least one first belt support at the input end and at least one second belt support downstream from the first belt support and a plurality of belts each extending from the first belt support to the second belt support, lower runs of the plurality of belts lying in a first plane or being bounded by the first plane, and the lower deck including a plurality of first lower shafts, an upstream-most one of the first lower shafts being located downstream from the first belt support, each of the first lower shafts supporting a plurality of contact elements, each of the contact elements having a contact surface movable around a closed path from a contact region to a non-contact region, the contact regions lying in a second plane or being bounded by the second plane;

a nip support at the input end forming an entrance nip with the plurality of belts;

a rejection support located beneath the main conveyor;

a plurality of paddles mounted at a first gap between the nip support and the upstream-most one of the plurality of first shafts; and an actuator operably connected to the plurality of paddles and configured to shift the plurality of paddles from a first position outside the sheet transport path to a second position extending into the sheet transport path, wherein the main transport path of the diverter conveyor is defined by the lower runs of the belts and by the nip support and by the contact surfaces of the plurality of contact elements, wherein the diverter conveyor is configured such that the sheets make direct contact with the lower runs of the belts and make direct contact with the contact surfaces of the plurality of contact elements when the sheets move along the main transport path, wherein the plurality of paddles in the second position is configured to divert the sheets from the main transport path into a diverted path and onto the rejection support, wherein the at least one first belt support comprises a plurality of first pulleys, wherein the at least one second belt support comprises a plurality of second pulleys, wherein each of the plurality of belts extends from one of the first pulleys to one of the second pulleys, and wherein when the plurality of paddles are located in the second position the plurality of paddles extend between adjacent pairs of the plurality of belts.

8. The diverter conveyor according to claim 7, wherein when the plurality of paddles are located in the first position, the first plane is located between the plurality of paddles and the second plane.

9. The diverter conveyor according to claim 8, wherein the rejection conveyor is supported by the frame.

10. The diverter conveyor according to claim 8, wherein the plurality of paddles are configured such that when the plurality of paddles are in the first position, sheets passing the second lower shaft in the downstream direction travel along the main transport path to the plurality of first wheels on the first lower shafts.

11. The diverter conveyor according to claim 10,
wherein the plurality of paddles are mounted on a rod,
wherein the rod is rotatably supported by the frame, and
including an actuator configured to rotate the rod to shift the plurality of paddles from the first position to the second position.

12. The diverter conveyor according to claim 10,
wherein the plurality of paddles are mounted on a beam, and
including means for moving the beam from a first location to a second location to shift the plurality of paddles from the first position to the second position.

13. The diverter conveyor according to claim 12, including a sensor configured to detect a condition of the sheets and to produce at least one output signal in response to the detection of the condition, and a controller configured to receive the at least one signal and to control the actuator based on the received at least one signal.

14. The diverter conveyor according to claim 10,
including a drive shaft supporting at least one drive gear and a drive operatively connected to the drive shaft to rotate the drive shaft in a first direction and in a second direction,
wherein the plurality of paddles are mounted on a first beam including at least one gear rack, and
wherein the at least one drive gear engages the at least one gear rack.

15. The diverter conveyor according to claim 14, including at least one diverter plate at the first gap between the second lower shaft and the upstream-most one of the first lower shafts, wherein the at least one diverter plate defines a boundary of the diverted path and is configured to divert the sheets toward the rejection conveyor.

16. The diverter conveyor according to claim 15, further including a controller configured to control the actuator.

17. A conveyor system comprising:
the diverter conveyor according to claim 1;
a feeding conveyor having an upstream end and having a downstream end spaced from the input end of the diverter conveyor and being configured to feed the sheets of material across a second gap between the downstream end of the feeding conveyor and the input end of the diverter conveyor; and
a receiving conveyor having an upstream end located at the outlet end of the diverter conveyor and having a downstream end, the upstream end of the receiving conveyor being spaced from the outlet end of the diverter conveyor by a third gap, the receiving conveyor being configured to receive the sheets from the outlet end of the diverter conveyor.

18. The diverter conveyor according to claim 17, wherein the condition of the sheets comprises a number of the sheets passing the sensor.

19. The diverter conveyor according to claim 1, wherein when the plurality of paddles is located in the first position, the first plane is located between the plurality of paddles and the second plane.

20. The diverter conveyor according to claim 1,
wherein an upstream-most portion of the upstream-most one of the first lower shafts is located downstream from a downstream-most portion of the at least one first belt support.

21. The diverter conveyor according to claim 1,
wherein the plurality of paddles in the second position is configured to divert the sheets from the main transport path through the first gap and into the diverted path.

22. A diverter conveyor configured to transport sheets along a main transport path in a downstream direction from an input end to a discharge end, the diverter conveyor comprising:
a frame;
a main conveyor including an upper deck supported by the frame and a lower deck supported by the frame,
the upper deck including at least one first belt support at the input end and at least one second belt support downstream from the first belt support and a plurality of belts each extending from the first belt support to the second belt support, lower runs of the plurality of belts lying in a first plane or being bounded by the first plane, and
the lower deck including a plurality of first lower shafts, an upstream-most one of the first lower shafts being located downstream from the first belt support, each of the first lower shafts supporting a plurality of first wheels having contact regions lying in a second plane or being bounded by the second plane;
a second shaft beneath the first belt support supporting a plurality of second wheels, the second wheels forming an entrance nip with the plurality of belts;
a rejection conveyor located beneath the main conveyor and supported by the frame;
a plurality of paddles mounted at a first gap between the second shaft and the upstream-most one of the plurality of first shafts,
at least one diverter plate at the first gap between the second lower shaft and upstream-most one of the first lower shafts, wherein the at least one diverter plate defines a boundary of the diverted path and is configured to divert the sheets toward the rejection conveyor;
an actuator operably connected to the plurality of paddles and configured to shift the plurality of paddles from a first position outside the sheet transport path to a second position extending into the sheet transport path; and
a controller operably connected to the actuator and configured to control the actuator,
wherein the main transport path of the diverter conveyor is defined by the lower runs of the belts and by the nip support and by the contact surfaces of the plurality of contact elements in the contact region,
wherein the diverter conveyor is configured such that the sheets make direct contact with the lower runs of the belts and make direct contact with the contact surfaces of the plurality of second wheels when the sheets move along the main transport path,
wherein the plurality of paddles in the second position is configured to divert the sheets from the main transport path into a diverted path and onto the rejection conveyor,
wherein when the plurality of paddles are located in the first position, the first plane is located between the plurality of paddles and the second plane, and
wherein when the plurality of paddles are located in the second position the plurality of paddles extend between adjacent pairs of the plurality of belts.

* * * * *